US007198326B2

(12) United States Patent
Chen

(10) Patent No.: US 7,198,326 B2
(45) Date of Patent: Apr. 3, 2007

(54) DESK AND CHAIR INTERCHANGEABLE DEVICE

(76) Inventor: Chao Ken Chen, 235 Chung-Ho Box 8-24 Taipei Taiwan, Chung-Hua Hsien (TW)

( * ) Notice: Subject to any disclaimer, the term of this patent is extended or adjusted under 35 U.S.C. 154(b) by 0 days.

(21) Appl. No.: 11/353,190

(22) Filed: Feb. 14, 2006

(65) Prior Publication Data

US 2007/0046076 A1 Mar. 1, 2007

(51) Int. Cl.
*A47B 85/04* (2006.01)

(52) U.S. Cl. ..... 297/124

(58) Field of Classification Search ..... 297/118, 297/119, 124, 125

See application file for complete search history.

(56) References Cited

U.S. PATENT DOCUMENTS 365,344 A * 6/1887 Lawrence ..... 297/125
645,102 A * 3/1900 Jennings ..... 297/124
679,617 A * 7/1901 Guthridge ..... 297/188.05
1,773,791 A * 8/1930 Rohrmann ..... 297/120
1,930,955 A * 10/1933 Harbottle et al. ..... 297/124
1,937,886 A * 12/1933 Grose ..... 297/124
2,814,334 A * 11/1957 Lane ..... 297/125
4,606,575 A * 8/1986 Kodet ..... 297/124
4,801,175 A * 1/1989 Albanese ..... 297/124
5,833,306 A * 11/1998 Breto ..... 297/124

* cited by examiner

*Primary Examiner*—Peter R. Brown

(57) ABSTRACT

A desk and chair interchangeable device which comprises a first plate; a second plate; a supporting unit having a first frame, and a second frame and a bearing frame for connecting the first frame and the second frame; a pivotal unit formed by a first pivotal seat, a second pivotal seat and a linkage; the first pivotal seat serving to pivotally connect one end of the linkage and the first plate; the second pivotal seat serving to pivotally connect another end of the linkage and the second plate so that the first plate can pivotally rotate; and an adjusting unit installed on the first plate for connecting the first plate to the first frame. The adjusting unit serves to adjust the elevation of the first plate; the pivotal unit serves to pivotally rotate the first plate to a horizontal position to be as a table plate.

8 Claims, 9 Drawing Sheets

DESK AND CHAIR INTERCHANGEABLE DEVICE

FIELD OF THE INVENTION

The present invention relates to furniture, and in particular to a desk and chair interchangeable device, wherein an adjusting unit is used to convert the desk and chair. Thereby one device can be used as a chair and a desk as desired. Thereby it only occupies a smaller space. The desk of the present invention also provides a drawer.

BACKGROUND OF THE INVENTION

In current trend, it requires that the furniture is multi-functional. For example, a desk can be converted into a chair or a chair can be converted into a desk. That is the desk and chair are interchangeable.

In one prior art about the desk and chair interchangeable device, each handle of a chair is hidden with a plate. When the plates are taken out from the handle and extend to a horizontal position, the chair can be converted into a chair. However the plate is extended outwards or forwards. As a result it is possible that the center of gravitation will be unstable. Furthermore, the plate is too smaller to be suitable in use. Thereby if the chair has no handle, the plate cannot be installed at a proper position.

In U.S. Pat. No. 1,513,651 and U.S. Application with Publication No. 2004/019730A1, desk and chair interchangeable devices are disclosed. In those disclosures, the back of the chair and seat of the chair are pivotally connected. The back and seat can be rotated to horizontal position so as to be as a desk. Although these are referred design, but no drawer is designed.

SUMMARY OF THE INVENTION

Accordingly, the primary object of the present invention is to provide a desk and chair interchangeable device, wherein an adjusting unit is used to convert the desk and chair. Thereby one device can be used as a chair and a desk as desired. Thereby it only occupies a smaller space. The desk of the present invention also provides a drawer.

To achieve above objects, the present invention provides a desk and chair interchangeable device which comprises a first plate; a second plate; a supporting unit having a first frame, and a second frame and a bearing frame for connecting the first frame and the second frame; a pivotal unit formed by a first pivotal seat, a second pivotal seat and a linkage; the first pivotal seat serving to pivotally connect one end of the linkage and the first plate; the second pivotal seat serving to pivotally connect another end of the linkage and the second plate so that the first plate can pivotally rotate; and an adjusting unit installed on the first plate for connecting the first plate to the first frame. The adjusting unit serves to adjust the elevation of the first plate; the pivotal unit serves to pivotally rotate the first plate to a horizontal position to be as a table plate and is positioned by the adjusting unit; and the second plate is motionlessly fixed to the supporting unit for receiving objects.

The various objects and advantages of the present invention will be more readily understood from the following detailed description when read in conjunction with the appended drawing.

DETAILED DESCRIPTION OF THE INVENTION

Figure 1:
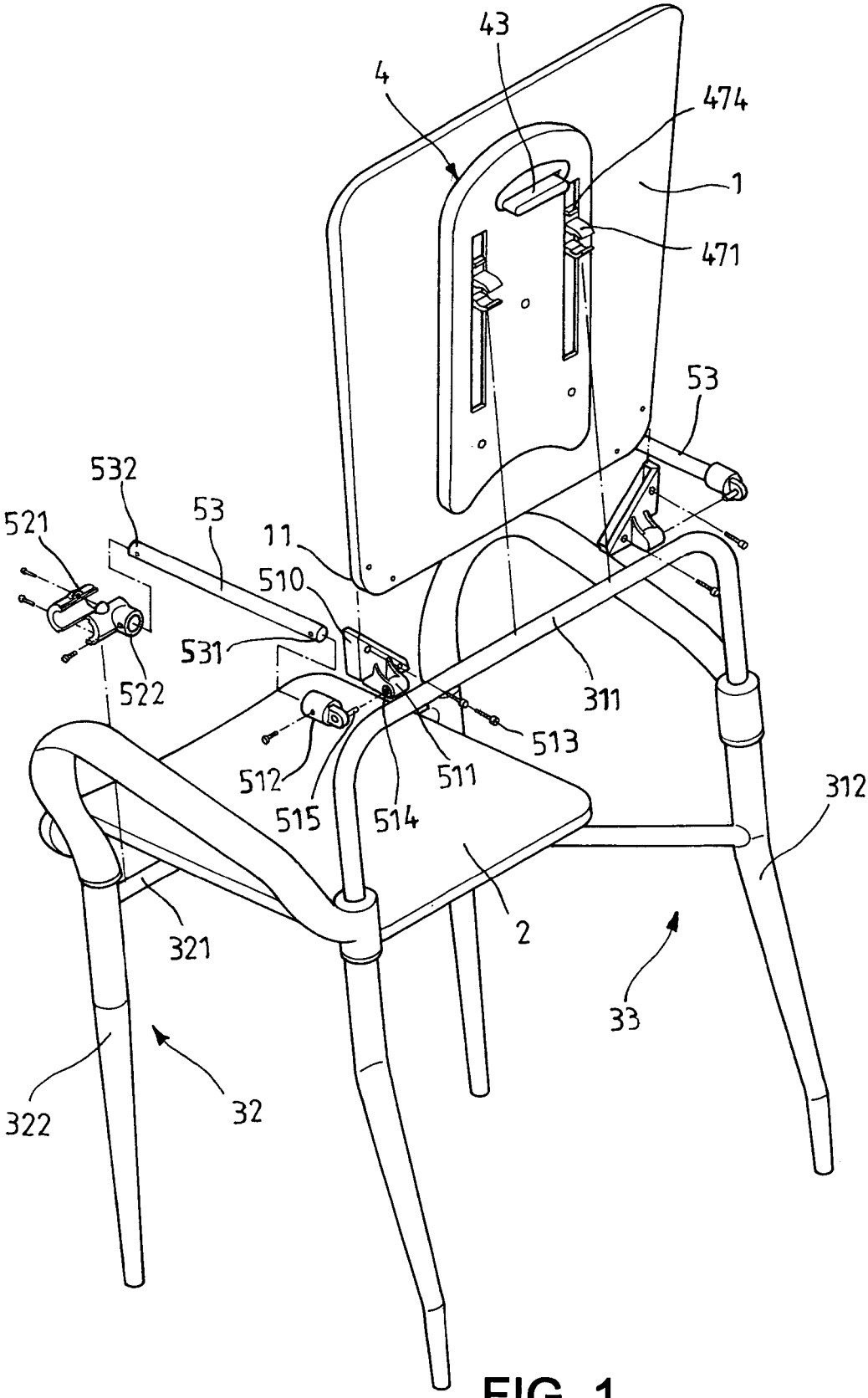
FIG. 1 is an exploded perspective view of the first embodiment of the desk and chair interchangeable device of the present invention.
Figure 2:
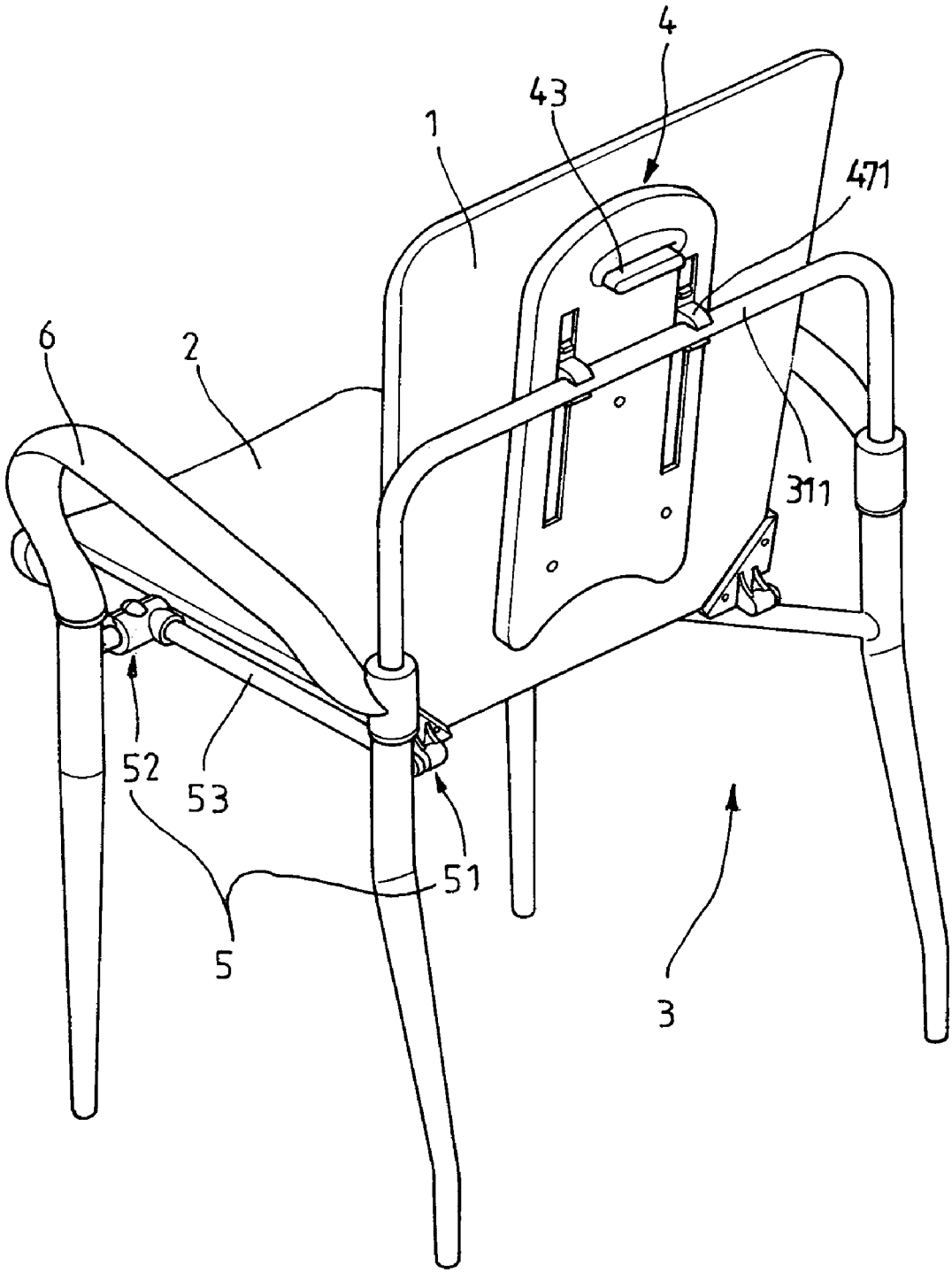
FIG. 2 is an assembled perspective view of the first embodiment of the desk and chair interchangeable device of the present invention.
Figure 3:
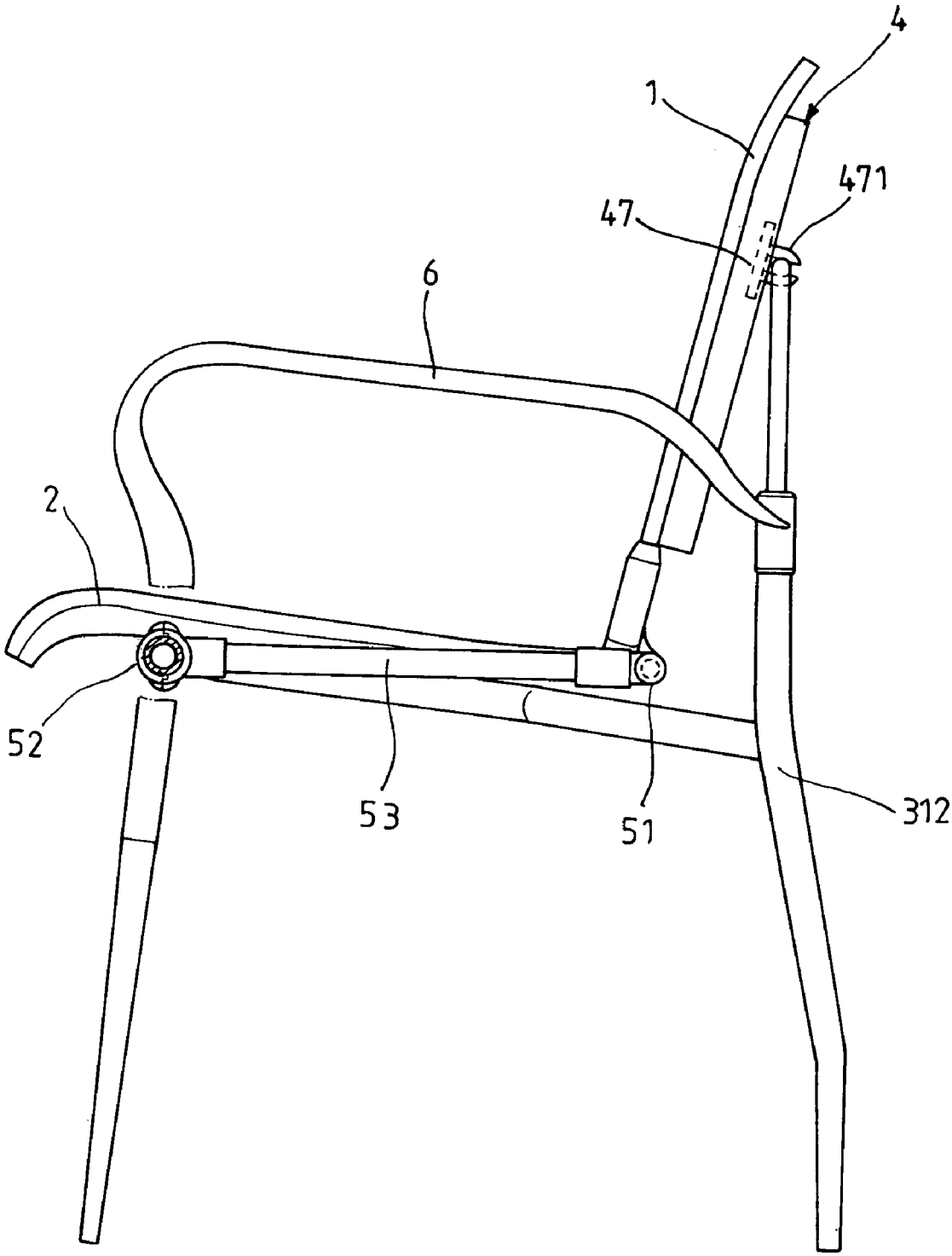
FIG. 3 is a lateral view about the desk and chair interchangeable device in FIG. 2.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the first embodiment of the present invention is illustrated. The present invention has the following elements.

A first plate 1 is included.

A second plate 2 is included.

A supporting unit 3 has a first frame 31, and a second frame 32 and a bearing frame 33 for connecting the first frame 31 and the second frame 32. The first frame 31 is formed by two legs 312 and a transversal bar 311 connected the two legs 312. The second frame 32 is formed by two legs 322 and a transversal bar 321 between the two legs 322. The transversal bar 311 of the first frame 31 is higher than the transversal bar 321 of the second frame 32.

A pivotal unit 5 is formed by a first pivotal seat 51, a second pivotal seat 52 and a linkage 53. The first pivotal seat 51 serves to pivotally connect one end of the linkage 53 and the first plate 1. The second pivotal seat 52 serves to pivotally connect another end of the linkage 53 and the supporting unit 3 so that the first plate 1 can pivotally rotate.

The first pivotal seat 51 includes a first seat 510, a sleeve 511 connected to the first seat 510; and a second seat connected to a first end portion 531 of the linkage 53. The first seat 510 is engaged to the first plate 1 near the corner 511 of the second plate 2 by using positioning screws 513. A surface of the sleeve 511 has a pivotal hole 514 facing toward a body of the linkage 53. The second seat 512 is pivotally installed with a pivotal shaft 515 at a position facing the pivotal hole 514. The pivotal shaft 515 passes through the pivotal hole 514 so as to have a pivotal rotation between the first plate 1 and the linkage 53.

The second seat 512 pivotally connects the supporting unit 3 and the linkage 53. The second seat 512 includes a first connecting seat 521 engaged to the supporting unit 3 and a second connecting seat 522. One end of the second connecting seat 522 is connected to a surface of the first connecting seat 521 and another end thereof is connected to the second end portion 532 and the linkage 53. When the linkage 53 is driven by the first plate 1, the first connecting seat 521 can rotate pivotally. In FIG. 1, the second connecting seat 522 is connected to the transversal bar 321 of the second frame 32 of the supporting unit 3, however this is only one embodiment, the second connecting seat 522 can be connected to for example, the second plate 2 or a handle 6 of the chair.

When the present invention is used as a chair, the first plate 1 is assembled to the transversal bar 311 of the first frame 31 by using an adjusting unit 4. The second plate 2 is fixed to the supporting unit 3. The first plate 1 is a back of the chair and the second plate 2 is the seat portion of the chair.

Figure 4:
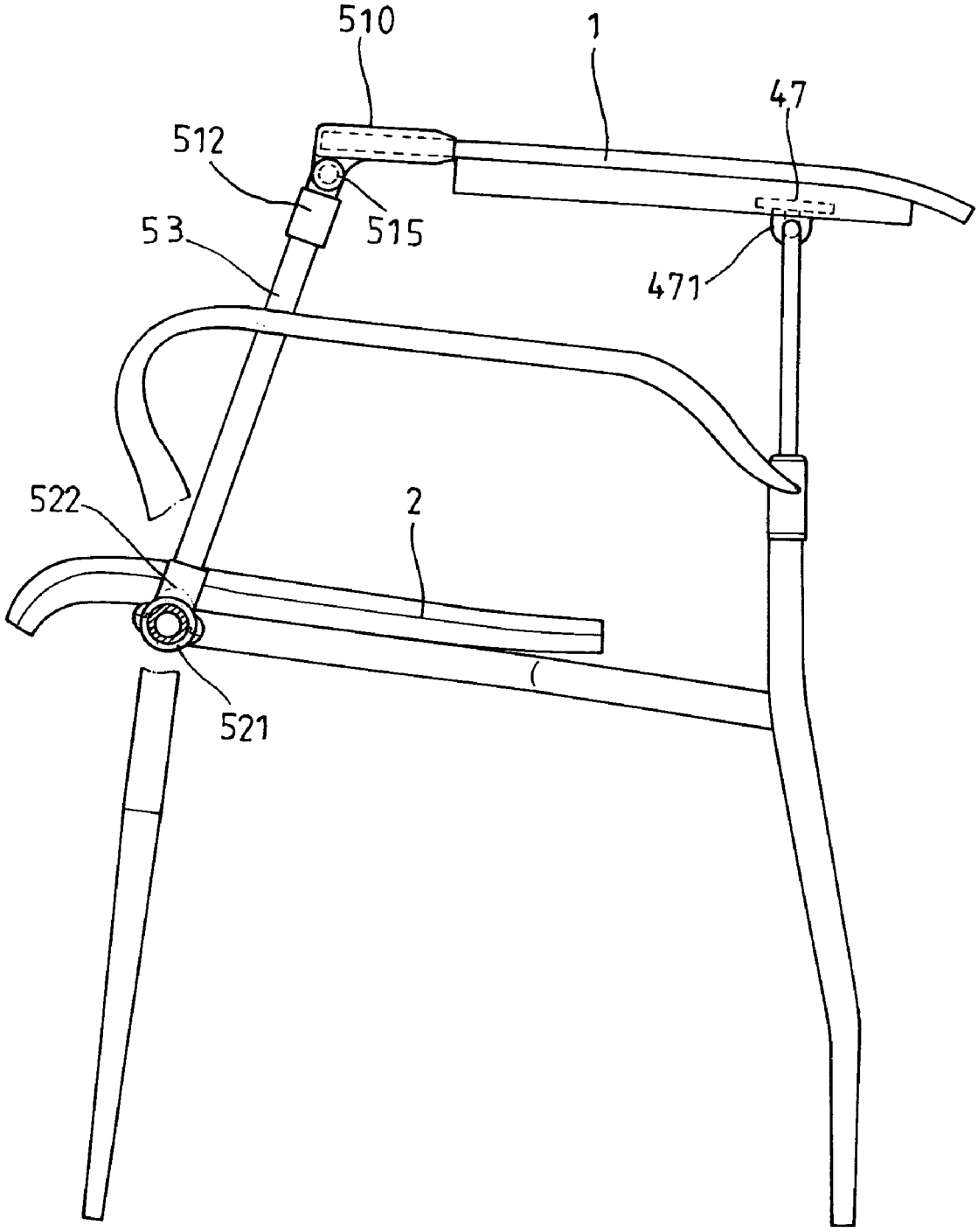
FIG. 4 is lateral view of FIG. 2, where a chair is changed into a desk.

FIG. 4 is a lateral cross sectional view showing that the present invention is changed as a table from a chair. By the action of the adjusting unit 4 and the pivotal unit 5, the first plate 1 is used as a table surface the second plate 2 is used as a drawer.

Figure 5:
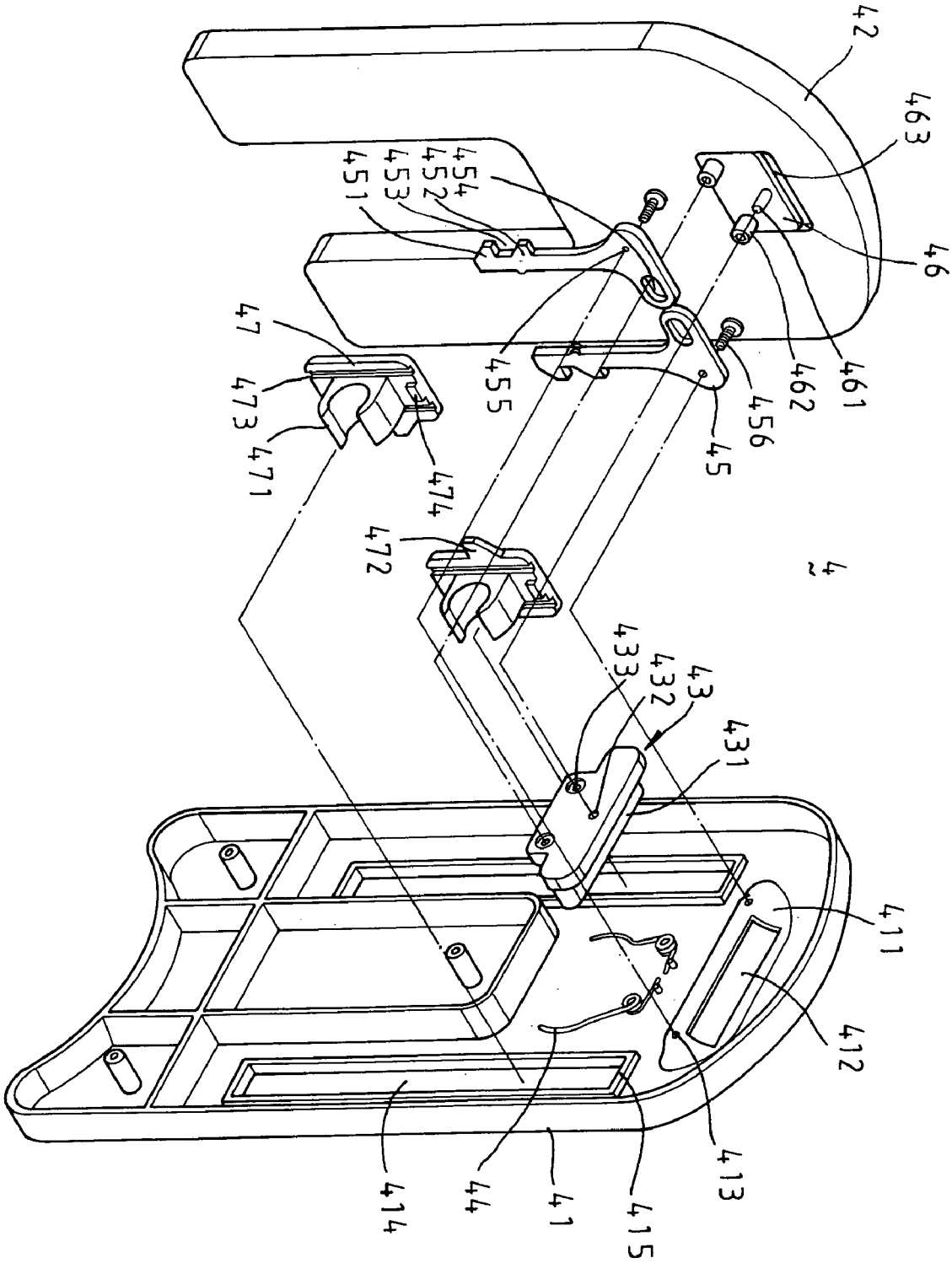
FIG. 5 is an exploded perspective view of the adjusting unit of the desk and chair interchangeable device of the present invention.
Figure 6:
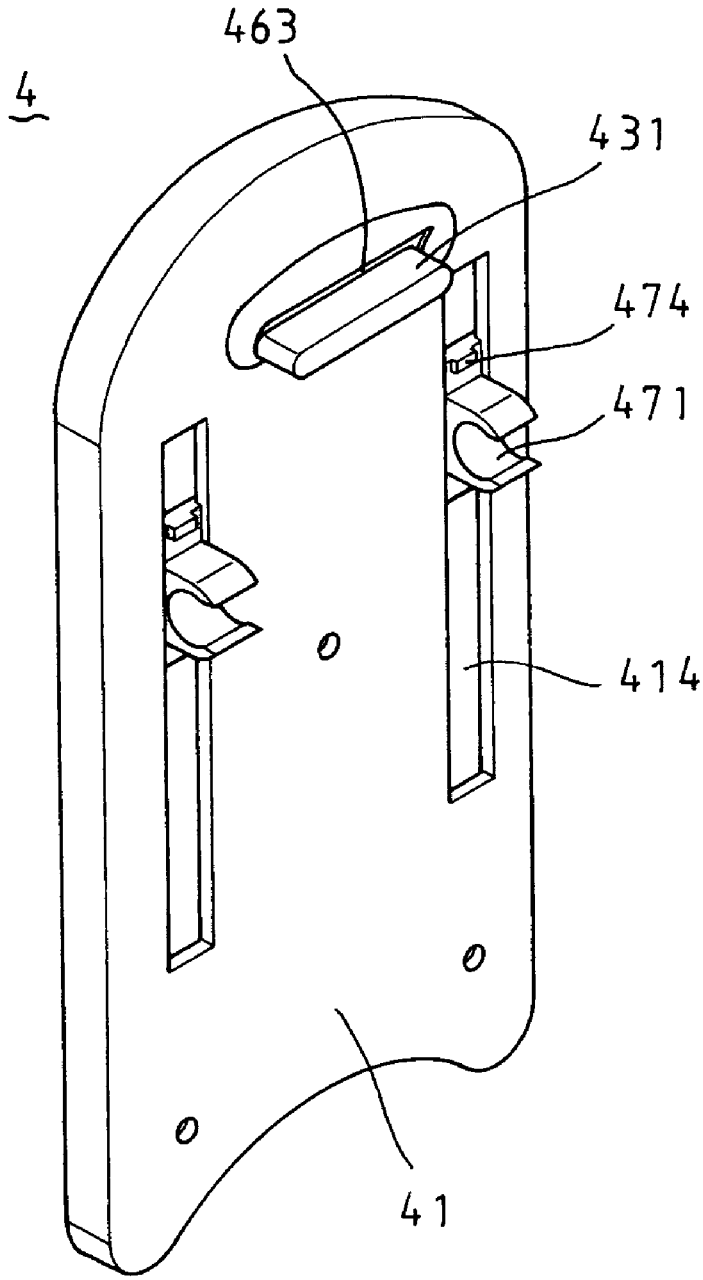
FIG. 6 is an assembled perspective view of the adjusting unit of the desk and chair interchangeable device of the present invention.

Referring to FIGS. 5 and 6, the adjusting unit 4 includes a casing 41, a bottom 42, an adjusting handle 43 between the casing 41 and the adjusting handle 43, two twisting springs 44, two actuators 45, a block 46 in a hole of the bottom 42 and two sliding units 47. A gap 463 is formed between the block 46 and an edge of the hole of the bottom 42.

An inner upper side of the casing 41 is formed with a recess 411. A slot 412 is formed in the recess 411. Each of two lower sides of the recess 411 is formed with a threaded hole 413. Each of two sides of the casing 41 is formed with a sliding groove 414. An outer edge of each sliding groove 414 is formed with a frame which is used as a guide track 415.

One side of the adjusting handle 43 is protruded with an operating unit 431 and another side thereof has a first adjusting hole 432 at an upper side of the adjusting handle 43 and two second adjusting holes 433 at a lower side of the adjusting handle 43.

Two twisting springs 44 are installed on the inner side of the casing 41 and between the two sliding grooves 414.

Each actuator 45 has an approximate L shape. An outer side of each actuator 45 is longitudinally installed with a first key 451 and a second key 452. A buckling portion 453 is formed between the first key 451 and the second key 452. An upper portion of the actuator 45 is formed with an opening 454 and a threaded hole 455 which are transversally arranged.

At a surface of the block 46 facing to the adjusting handle 43 has a first post 461 and a second post 462 corresponding to the first adjusting hole 432 and the second adjusting hole 433 of the adjusting handle 43.

At a surface of each sliding unit 47 facing the sliding grooves 414 of the casing 41 has a movable hook 471 which is movable within the guide track 415 at the edge of the sliding groove 414. An upper side of the block 46 is installed with a resisting portion 474 at a surface identical to the one installing the movable hook 471 for limiting the movement of the movable hook 471 in the sliding groove 414. One lateral side of the block 46 is formed with a buckling key 472 which is interacted with the first key 451, second key 452 and buckling portion 453 of the actuator 45.

In assembly, the operating unit 431 of the actuator 45 passes through the slot 412 of the casing 41. Then a screw 456 passes through the threaded hole 455 of the actuator 45 and is locked to the threaded hole 413 of the casing 41. Then the openings 454 of the actuators 45 are aligned to the second adjusting holes of the adjusting handle 43. Then the second post 462 of the block 46 passes through the opening 454 of the actuator 45 to be inserted into the second adjusting hole 433 of the actuator 45. The first post 461 is directly engaged to the first adjusting hole 432 of the adjusting handle 43. The sliding units 47 is loosely arranged between the casing 41 and the bottom 42. By the guide groove 473 and the guide track 415 of the sliding groove 414, it is movable along the guide track 415. The movable hook 471 passes through the sliding groove 414 to slide within the sliding groove 414. By the first key 451, second key 452 and buckling portion 453 of the adjusting handle 43 between the twisting springs 44 and the sliding unit 47 and the buckling key 472 of the sliding unit 47, the sliding unit 47 is slideable and positioned in the sliding groove 414.

Figure 7:
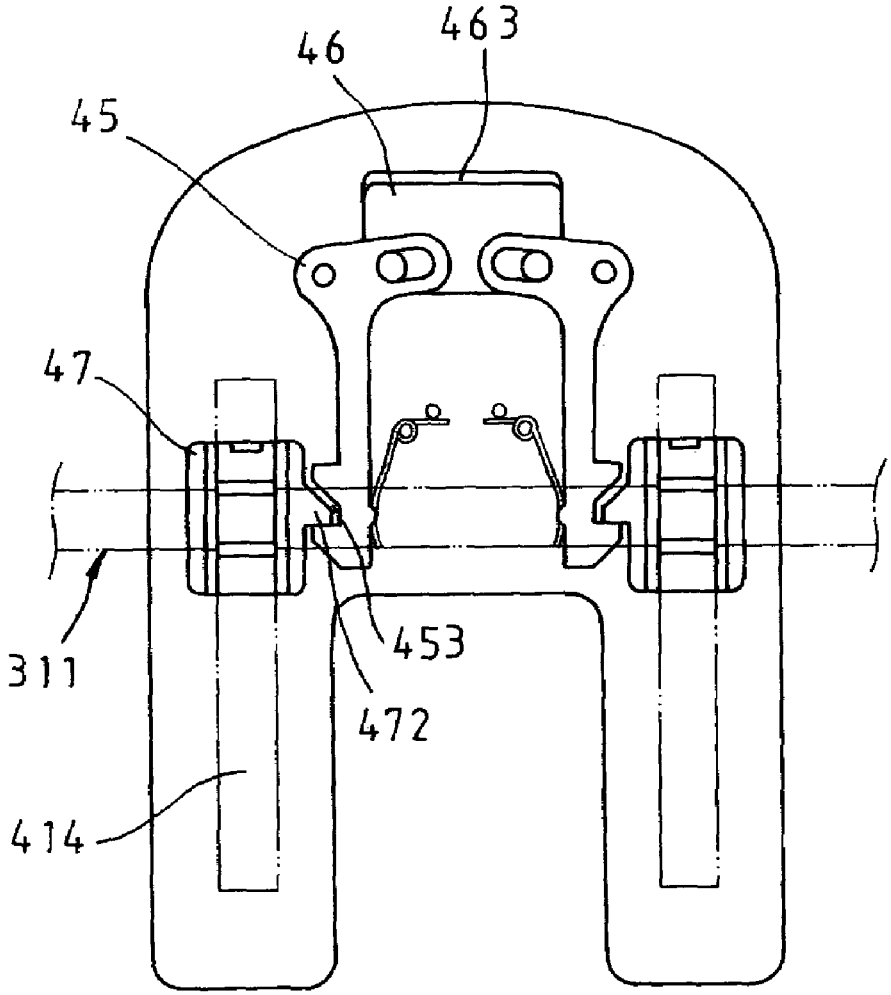
FIGS. 7 to 9 are schematic views showing the operation of the present invention, wherein the present invention is converted into a desk from a chair.
Figure 8:
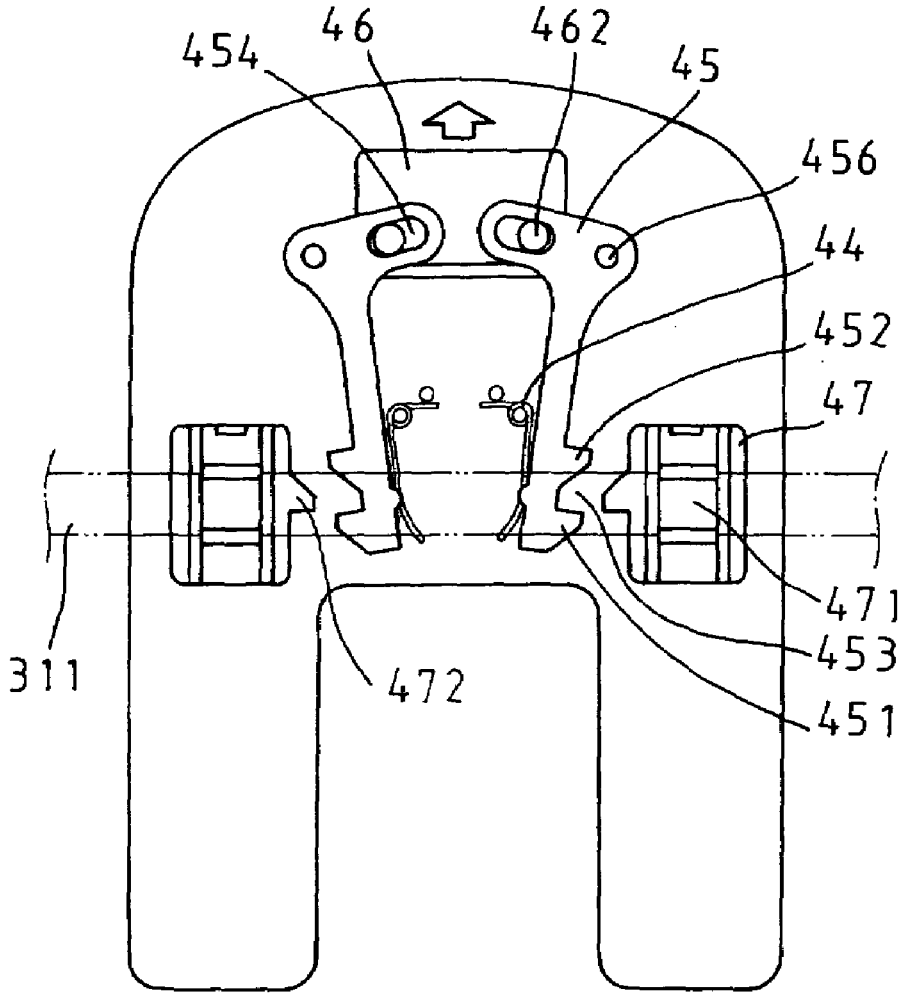
Figure 9:
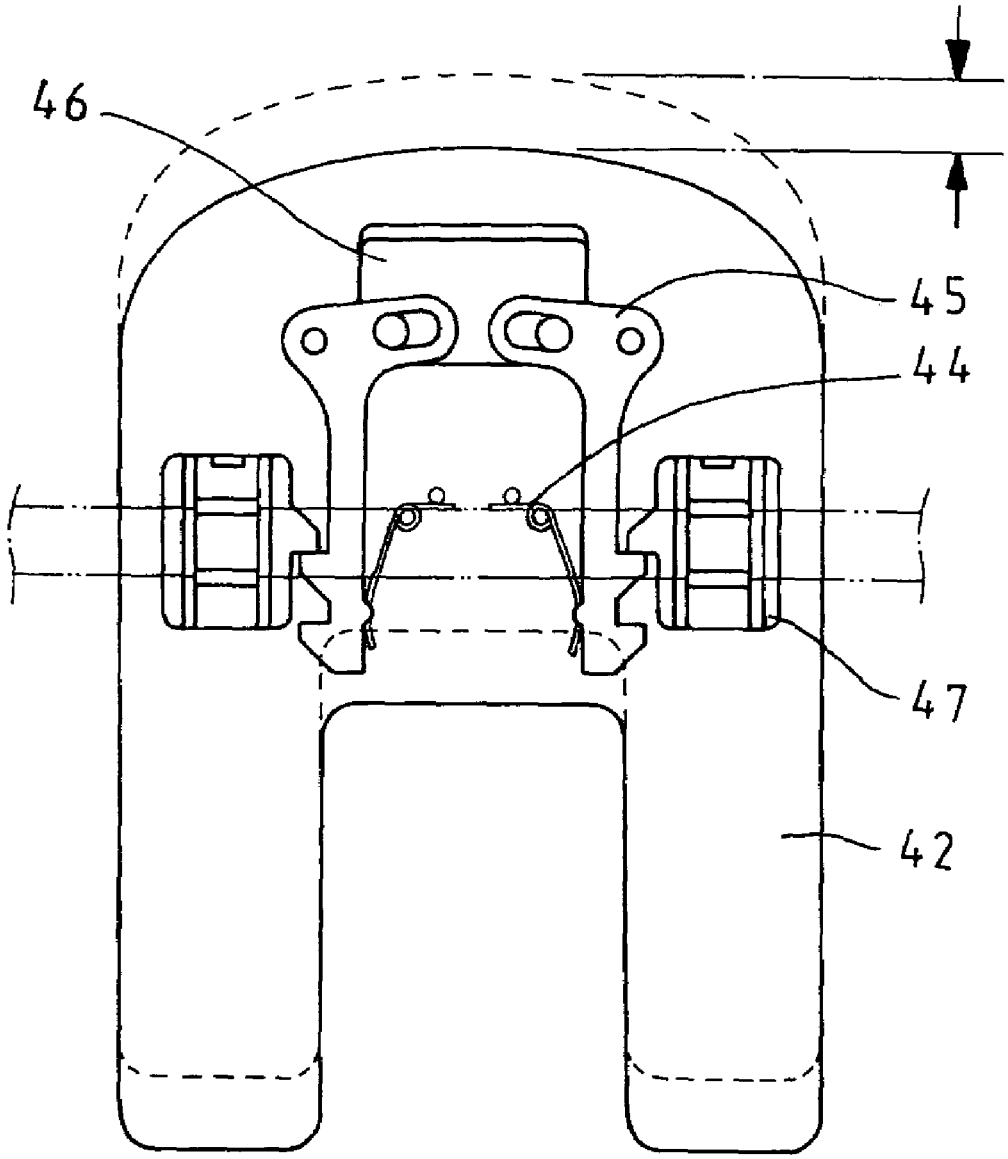

When it is desired to change a chair into a table according to the present invention, as shown in FIGS. 7 to 9, when the present invention is at a chair state, the buckling key 472 of the sliding unit 47 is at the buckling portion 453 of the actuator 45. Since the gap 463 is formed at an upper part of the block 46, by a force, the actuator 45 can move toward the gap 463 so as to drive the buckling portion 453 of the adjusting handle 43 to leave from the buckling key 472. The movable hook 471 clamps the transversal bar 311 of the first frame 31. In pivotal rotation, it limitedly slides in the sliding groove 414 so as to push the pivotal unit 5 and then the first plate 1 (i.e. the back of the chair) pivotally rotates to a horizontal direction. The second plate 2 originally in a horizontal position is still motionless. That is, when the chair is wanted to be converted into a desk, the extension space needed in the back of the chair is achieved by the movable hook 471 to move in the sliding groove 414. When the first plate 1 rotates to a desk (referring to FIG. 4), the buckling key 472 of the sliding unit 47 is above the second key 452 of the actuator 45. The first key 451 and second key 452 serve to provide a space for adjusting the position of the first plate 1 so as to be in horizontal position.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A desk and chair interchangeable device comprising:

a first plate, wherein as the desk and chair interchangeable device is used as a chair, the first plate is used as a vertical backrest;

a second plate, wherein as the desk and chair interchangeable device is used as a chair, the second plate is used as a seat portion;

a supporting unit having a first frame, and a second frame and a bearing frame for connecting the first frame and the second frame; and the first frame being formed by two legs and a transversal bar connected the two legs;

and the second frame being formed by two legs and a transversal bar between the two legs;

a pivotal unit formed by a first pivotal seat, a second pivotal seat and a linkage; the first pivotal seat serving to pivotally connect one end of the linkage and the first plate; the second pivotal seat serving to pivotally connect another end of the linkage and the second plate so that the first plate is pivotally rotatable; and an adjusting unit installed on the first plate for connecting the first plate to the first frame;

wherein the adjusting unit serves to adjust the elevation of the first plate; the pivotal unit serves to pivotally rotate the first plate to a horizontal position to be as a table plate and is positioned by the adjusting unit; and the second plate is motionlessly fixed to the supporting unit for receiving objects:

wherein the first pivotal seat includes a first seat, a sleeve connected to the first seat; and a second seat connected to a first end portion of the linkage; the first seat is engaged to the first plate near the corner of the second plate by using positioning screws; a surface of the sleeve has a pivotal hole facing toward a body of the linkage; the second seat is pivotally installed with a pivotal shaft at a position facing the pivotal hole; the pivotal shaft passes through the pivotal hole so as to have a pivotal rotation between the first plate and the linkage.

2. A desk and chair interchangeable device comprising:

a first plate, wherein as the desk and chair interchangeable device is used as a chair, the first plate is used as a vertical backrest;

a second plate, wherein as the desk and chair interchangeable device is used as a chair, the second plate is used as a seat portion;

a supporting unit having a first frame, and a second frame and a bearing frame for connecting the first frame and the second frame; and the first frame being formed by two legs and a transversal bar connected the two legs; and the second frame being formed by two legs and a transversal bar between the two legs;

a pivotal unit formed by a first pivotal seat, a second pivotal seat and a linkage; the first pivotal seat serving to pivotally connect one end of the linkage and the first plate: the second pivotal seat serving to pivotally connect another end of the linkage and the second plate so that the first plate is pivotally rotatable; and an adjusting unit installed on the first plate for connecting the first plate to the first frame;

wherein the adjusting unit serves to adjust the elevation of the first plate; the pivotal unit serves to pivotally rotate the first plate to a horizontal position to be as a table plate and is positioned by the adjusting unit; and the second plate is motionlessly fixed to the supporting unit for receiving objects;

wherein the adjusting unit includes a casing, a bottom, an adjusting handle between the casing and the bottom, two twisting springs at an inner side of the casing, two actuators at an inner side of the bottom, a block in a hole of the bottom and two sliding units located in a space between the casing and the bottom and being protruded from two sliding grooves in the casing.

3. The desk and chair interchangeable device as claimed in claim 2, wherein an inner upper side of the casing 41 is formed with a recess; a slot is formed in the recess; a gap is formed between the block and an edge of the hole of the bottom.

4. The desk and chair interchangeable device as claimed in claim 2, wherein one side of the adjusting handle is protruded with an operating unit; said two twisting springs are installed on the inner side of the casing and between the two sliding grooves; in assembly, the adjusting handle is at the recess; and the operation unit passes through the slot of the casing and the actuator is installed between the block and the adjusting handle; by the elastic force of the twisting springs, the sliding unit is buckled.

5. The desk and chair interchangeable device as claimed in claim 2, wherein an outer side of each actuator is longitudinally installed with a first key and a second key; a buckling portion is formed between the first key and the second key; an upper portion of the actuator is formed with an opening and a threaded hole which are transversely arranged.

6. The desk and chair interchangeable device as claimed in claim 2, wherein each of two sides of the casing is formed with a sliding groove; an outer edge of each sliding groove is formed with a frame which is used as a guide track, the sliding unit is moveable in the sliding groove by the engagement of the sliding groove and the guide track.

7. The desk and chair interchangeable device as claimed in claim 2, wherein at a surface of each sliding unit facing the sliding grooves of the casing has a movable hook which is movable within the guide track at the edge of the sliding groove; an upper side of the block is installed with a resisting portion at a surface identical to the one installing the movable hook for limiting the movement of the movable hook in the sliding groove.

8. The desk and chair interchangeable device as claimed in claim 2, wherein one lateral side of the block is formed with a buckling key which is interacted with a first key, a second key and a buckling portion of the actuator.

* * * * *